US005796327A

United States Patent [19]

Smith

[11] Patent Number: 5,796,327

[45] Date of Patent: Aug. 18, 1998

[54] THERMALLY RESPONSIVE ELECTRICAL SWITCHES

[75] Inventor: David Andrew Smith, Buxton, England

[73] Assignee: Otter Controls Limited, Derbeyshire, England

[21] Appl. No.: 596,085

[22] PCT Filed: Aug. 3, 1994

[86] PCT No.: PCT/GB94/01709

§ 371 Date: Aug. 19, 1996

§ 102(e) Date: Aug. 19, 1996

[87] PCT Pub. No.: WO95/04364

PCT Pub. Date: Feb. 9, 1995

[30] Foreign Application Priority Data

Aug. 3, 1993 [GB] United Kingdom ..... 9316103
Nov. 26, 1993 [GB] United Kingdom ..... 9324380

[51] Int. Cl.[6] ..... H01H 37/52; H01H 5/00

[52] U.S. Cl. ..... 337/342; 337/89; 337/333; 337/52; 337/388

[58] Field of Search ..... 337/3, 12, 16, 337/53, 52, 85, 89, 131, 333, 342, 343, 365, 372, 375, 379, 380, 388, 398

[56] References Cited

U.S. PATENT DOCUMENTS

| | | | |
|---|---|---|---|
| 3,242,292 | 3/1966 | Malone . | |
| 3,573,697 | 4/1971 | Dennis et al. . | |
| 3,936,788 | 2/1976 | Uchiya . | |
| 4,013,988 | 3/1977 | Holden . | |
| 4,507,642 | 3/1985 | Blackburn | 337/89 |
| 4,914,414 | 4/1990 | Ubukata et al. | 337/368 |
| 5,082,997 | 1/1992 | Vialy | 200/452 |
| 5,196,820 | 3/1993 | Ubukata | 337/368 |
| 5,367,279 | 11/1994 | Sakai | 337/104 |

*Primary Examiner*—Leo P. Picard
*Assistant Examiner*—Jayprakash N. Gandhi
*Attorney, Agent, or Firm*—Pollock, Vande Sande & Priddy

[57] ABSTRACT

A thermally-responsive current-sensitive switch having a molded plastic body containing first and second terminals in the form of metal stampings and having an internal chamber wherein a leaf spring and a snap-acting bimetallic blade of the same shape are together spot-welded to one of the terminals with the leaf spring underlying the bimetal in registry therewith and at its other end carrying a sliver contact which cooperates in switching operations with the other switch terminal. In one embodiment, the spring bias of the leaf spring tends to open the switch and the force generated by the bimetal in its contacts-closing movement is sufficient to overcome the spring bias of the leaf spring, whereas in another embodiment the leaf spring develops either a neutral force or a contacts-opening force. The leaf spring electrically shunts the bimetal, whereby the current-carrying capability of the switch is increased and different switch specifications can use the same bimetal with different leaf springs.

18 Claims, 8 Drawing Sheets

FIG. 1A.
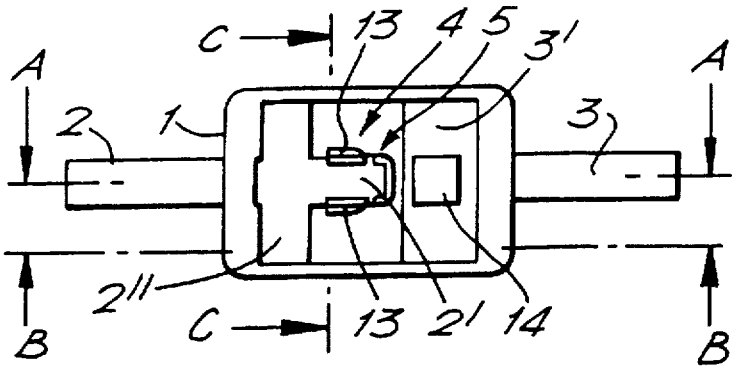
FIG. 1B.
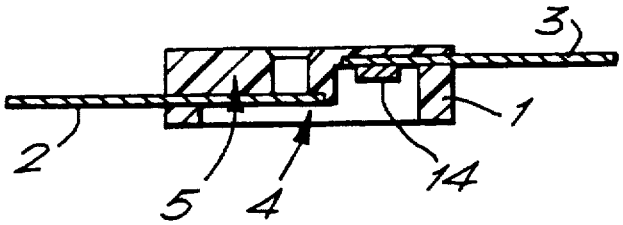
FIG. 1C.
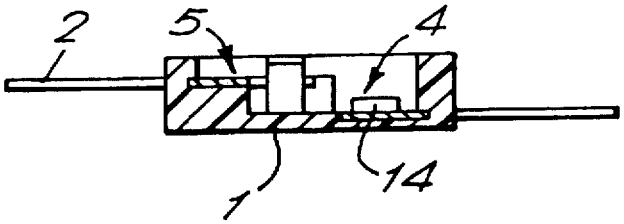
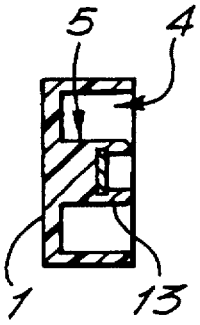
FIG. 1D.
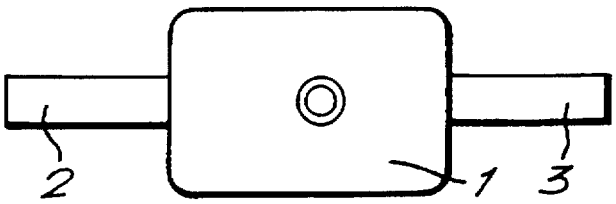
FIG. 1E.

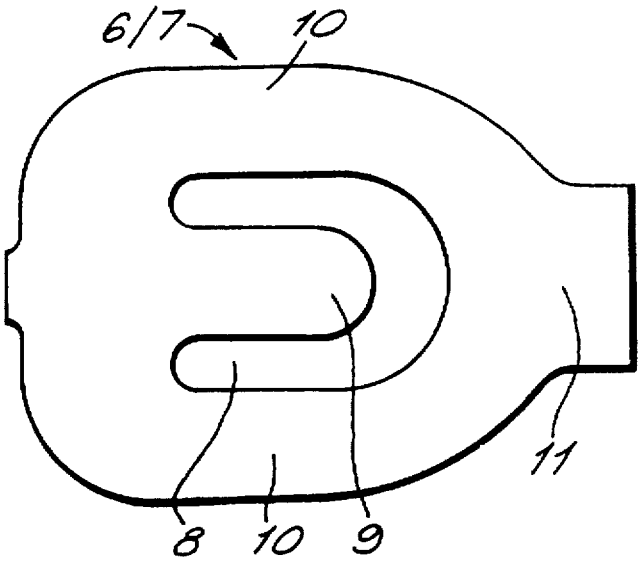
FIG. 2.
FIG. 3.
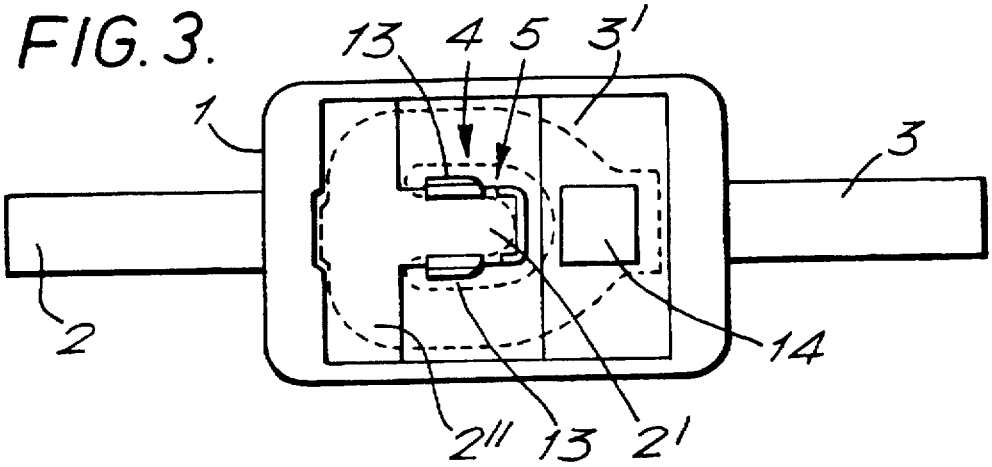
FIG. 4.
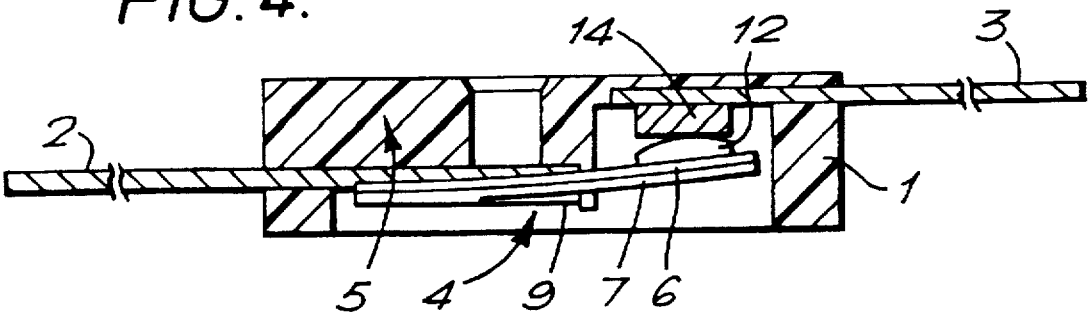

FIG. 5A.
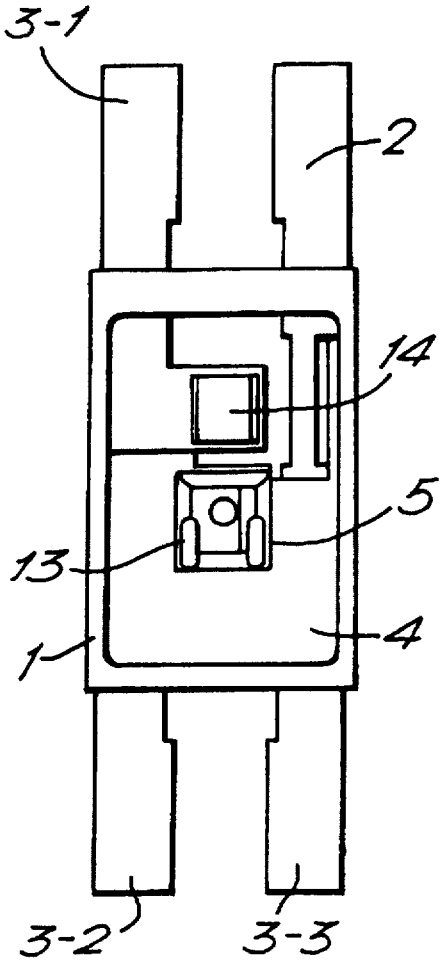
FIG. 5B.
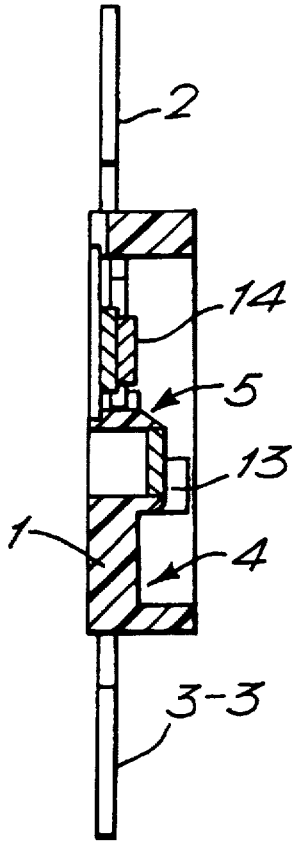
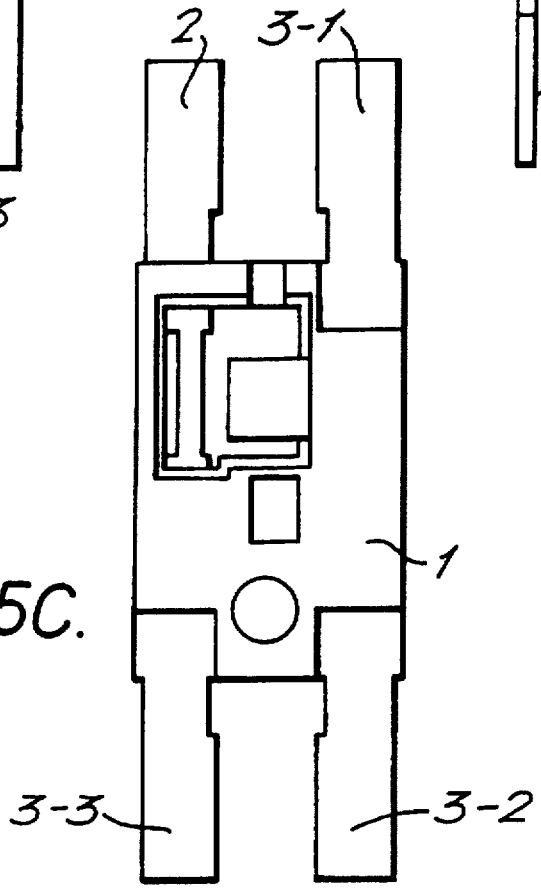
FIG. 5C.

FIG. 5D.
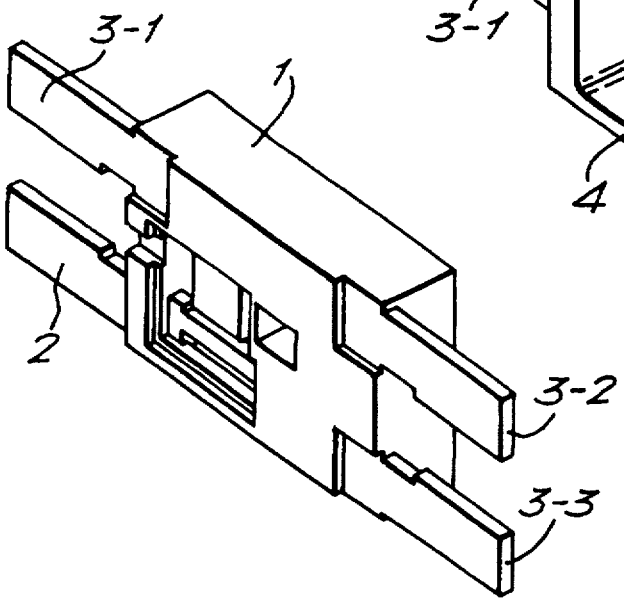
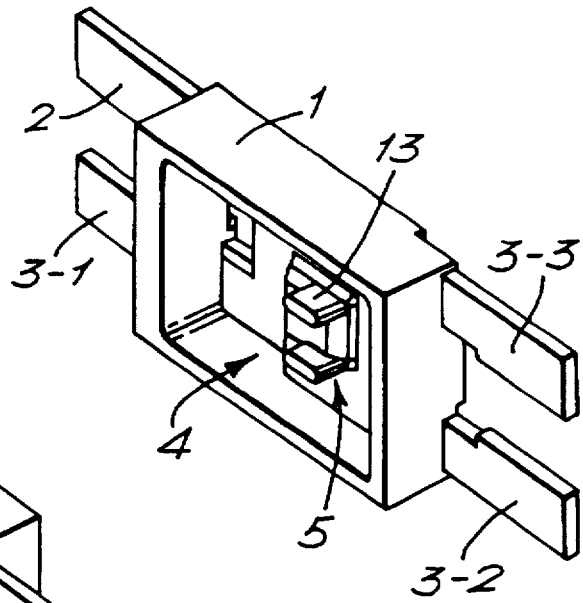
FIG. 5E.
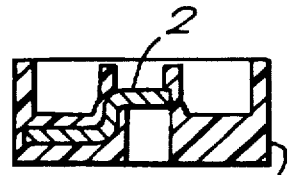
FIG. 5F.
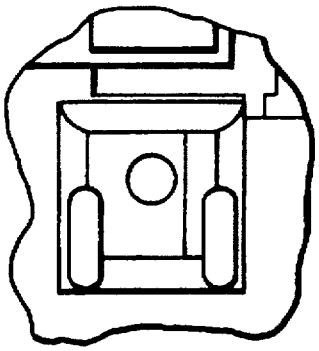
FIG. 5G.
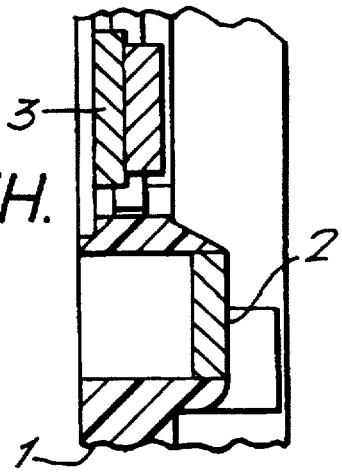
FIG. 5H.
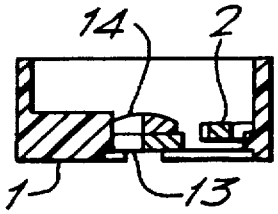
FIG. 5I.

THERMALLY RESPONSIVE ELECTRICAL SWITCHES

FIELD OF THE INVENTION

This invention concerns improvements relating to electric switches and more particularly concerns thermally responsive electrical switches employing bimetallic elements as thermal actuators.

BACKGROUND OF THE INVENTION

Many kinds of electrical switches employing bimetallic actuators are known and likewise many different forms of bimetallic switch actuators are known. Early bimetallic switches simply employed a plain bimetal blade which moved relatively slowly in response to temperature changes and gave rise to arcing problems in the switch, and the development of the snap-acting bimetallic actuator, constructed as a dished bimetallic element capable of moving between oppositely curved configurations with a snap action, provided a major advance in the art. Various forms of snap-acting bimetallic actuators are known, such as those disclosed in GB 600055, GB 657434, GB 1064643, GB 1542252 and GB 2124429 for example. Likewise, various forms of electric switches employing such bimetallic actuators are known; GB 2124429 abovementioned for example discloses the utilization of a pear-shaped snap-acting bimetallic actuator in a current-sensitive switch where the heating of the bimetal by flow of electric current therethrough is designed to trip the switch in a current overload situation.

In WO 92/20086 there is described a miniature electrical switch employing a snap-acting bimetallic actuator, the switch being well suited to automatic manufacture and installation and comprising a minimum number of parts. The switch comprises a moulded plastics body portion which captures therein first and second terminal conductors, and a snap-acting bimetallic actuator is secured to one of the two conductors and carries a contact which constitutes the moving contact of the switch and is arranged for co-operation in switching operations with the other of the two conductors. The switch can be made highly current sensitive by use of a bimetallic material of very low thickness (eg. 0.003 inch: 0.076 mm) and the internal construction of the switch body can be designed to provide physical support for such a thin bimetallic element. The possibility is further described of providing a silver or silver alloy coating, for example a silver antimony coating as described in WO 92/14282 on the terminal conductor which co-operates with the moving switch contact carried by the bimetal so as to enable an otherwise plain conductor to be utilized without need for attachment of a discrete contact to the conductor.

To enhance the current sensitivity of the switch, the possibility is further disclosed to provide a series-connected heating element in the switch for injecting heat into the bimetallic actuator when the switch is in closed condition, and in a particularly convenient arrangement this is achieved by forming the heating element as a portion of one or other, or both, of the two terminal conductors. Yet another possibility is to provide a heating element in parallel with the switch conductors, for example by use of a conductive ink printed on the switch body portion, the effect of this being to inhibit resetting of the switch so long as its power supply remains connected.

OBJECTS AND SUMMARY OF THE INVENTION

One object of the present invention is to enable the provision of a thermally-responsive switch incorporating a bimetallic switch actuator, the switch obtaining the advantages of the switch of WO 92/20086 abovementioned and furthermore providing for increased current carrying capacity and preferably, though not essentially, for increased first break times to avoid nuisance tripping of the switch.

According to the present invention, in one of its aspects, there is provided a thermally-responsive switch comprising a moulded plastics body portion capturing therein first and second terminal conductors, a leaf spring secured to one of said conductors and carrying a contact which constitutes the moving contact of the switch and is arranged for co-operation in switching operations with the other of the two conductors, and a snap-acting bimetallic actuator secured to said one of said conductors and co-operating with said leaf spring to determine the condition of the switch, the bimetallic actuator being electrically shunted by the leaf spring.

In a first embodiment of the invention which is described in detail hereinafter, the snap-acting bimetallic actuator of a switch substantially as described in WO 92/20086 is shunted by means of an electrically conductive leaf spring which carries the moving contact of the switch, the leaf spring underlying the bimetallic actuator and generating a spring force which is directed so as to tend to open the switch but will be overcome by the force developed by the bimetallic actuator in its cold condition.

More particularly, the aforesaid embodiment of the present invention comprises a moulded plastics body portion capturing therein first and second terminal conductors, a leaf spring secured to one of said conductors and carrying a contact which constitutes the moving contact of the switch and is arranged for co-operation in switching operations with the other of the two conductors, and a snap-acting bimetallic actuator secured to said one of said conductors and co-operating with said leaf spring to determine the condition of the switch, the leaf spring generating a spring force tending to open the switch contacts and the bimetallic actuator overlying the leaf spring and developing in its cold condition a force such as to overcome the spring force of the leaf spring, the bimetal being electrically shunted by the leaf spring.

The operation of the leaf spring in this embodiment in opposition to the bimetal ensures that when operated the spring remains in contact with and electrically shunts the bimetal, thereby increasing the current carrying capacity of the switch and increasing first break times since only a proportion of the through current of the switch flows in the bimetal. Furthermore, when the bimetal moves to its hot condition the spring force generated by the leaf spring will tend to oppose resetting of the bimetal, thereby extending the off time of the switch which is advantageous in protective applications.

In an alternative embodiment of the present invention which is described hereinafter, the leaf spring does not necessarily oppose the bimetal with a switch-opening spring force, but rather may be neutral or may even develop a switch-closing spring force, and the leaf spring and bimetal are coupled together in a manner which accommodates their individual movements whilst ensuring that they move together in switching operations. The leaf spring has an end portion which is turned upwards out of the general plane of the spring and an aperture is formed in such end portion, and the bimetallic actuator has a portion which extends through the aperture in the leaf spring end portion with a sufficient clearance to ensure that there is substantially no resistance to relative movement between the leaf spring and the bimetallic actuator generally in the direction of their longitudinal extent. Alternative means of coupling the leaf spring and the bimetallic actuator will occur to those possessed of relevant skills; for example the leaf spring and/or the bimetallic actuator could be provided with one or more tabs folded over so as loosely to entrap the other part.

By arranging the leaf spring so that it develops a switch-closing spring force, in contrast to a neutral or switch opening force, the advantage is obtained that an increased contact pressure can be achieved in the switch when the temperature is close to the break temperature at which the switch will be opened by the bimetallic actuator, particularly when a snap-acting bimetallic actuator is employed. By this means a precise and predetermined switch action can be achieved which is not susceptible to creepage problems.

The leaf spring and the bimetallic actuator in both of the aforementioned embodiments may advantageously be similarly shaped and may even be produced by use of the same tooling in an automated manufacturing procedure employing interchangeable punches and/or dies. Thus in the embodiment of the invention which are described hereinafter, the bimetallic actuator comprises a dished bimetallic blade having a generally U-shaped cut-out defining a central tongue extending between a pair of external legs which are bridged by a bridging portion adjacent the tip of the tongue, and the leaf spring is substantially identically shaped and lies beneath the bimetallic actuator in registry therewith. The tongue of the bimetallic blade and the corresponding part of the leaf spring are commonly secured to said one of said conductors, for example by spot welding, and the moving contact of the switch is carried by the part of the leaf spring that corresponds to the bridging portion of the bimetallic actuator. The moulded plastics body portion of the switch accommodates the bimetallic actuator and the leaf spring, and an upstand is defined within said chamber and provides support for the tongue of the bimetallic blade and for the corresponding part of the leaf spring where they attach to the terminal conductor. With such similar bimetallic blade and leaf spring configurations, the bimetal and the leaf spring can advantageously be assembled together, as a sub-assembly, prior to their assembly together into the switch, which has advantages as regards the assembly of the switch.

Similarly to the invention described in WO 92/20086, the moulded plastics body portion of the switch preferably defines a closed chamber which accommodates the leaf spring and the bimetallic actuator, the first and second terminal conductors are moulded into the body portion of the switch at spaced-apart locations so as to have exposed portions spaced apart from each other within said chamber and externally of the body portion, the bimetallic actuator and the leaf spring are directly welded to the exposed portion of said one of said conductors within the chamber, and the contact carried by the leaf spring co-operates with a contact defined by or provided on the exposed portion of the other of the two conductors within the chamber.

Further advantages arise by virtue of the fact that switches having different switching characteristics can be obtained according to the teachings of the present invention simply by use of different leaf springs having different electrical and/or physical properties, advantageously without need to change the bimetal though this would provide additional possibilities, and in that the provision of the leaf spring avoids the need for welding of the moving contact of the switch to the bimetal (bimetallic materials are generally difficult welding materials).

The above and further features and aspects of the present invention are set forth with particularity in the appended claims and will be made clear in the following description of exemplary embodiments of the invention which are illustrated in the accompanying drawings.

BRIEF DESCRIPTION OF THE DRAWINGS

FIGS. 1A to 1E show the moulded plastics body part of a first exemplary switch in accordance with the present invention, with a closure member omitted and showing first and second terminal conductors captured in the body part, and with the leaf spring and bimetallic actuator of the switch also omitted, FIG. 1A being a top plan view, FIGS. 1B and 1C being cross-sectional side elevation views on the lines A . . . A and B . . . B respectively in FIG. 1A, FIG. 1D being a cross-sectional end elevation view on the line C . . . C in FIG. 1A, and FIG. 1E being a bottom plan view of the switch of FIG. 1A;

FIG. 2 is an enlarged showing of the shape of a leaf spring and of a bimetallic actuator which may be used in the switch body part of FIGS. 1A to 1E;

FIG. 3 is an enlarged top plan view similar to FIG. 1A and showing in broken lines the position of the leaf spring and bimetallic actuator;

FIG. 4 is a cross-sectional side elevation view similar to FIG. 1B but showing the leaf spring and bimetallic actuator in place;

FIGS. 5A to 5I are views showing a second embodiment of the present invention with the leaf spring and bimetallic actuator omitted and further omitting a closure member, FIGS. 5A, 5B and 5C showing top plan, cross-sectional and bottom plan views respectively, FIGS. 5D and 5E showing perspective views, and FIGS. 5F to 5I showing other detail views as will be described more fully hereinafter;

DETAILED DESCRIPTION OF THE EMBODIMENTS

Figure 6:
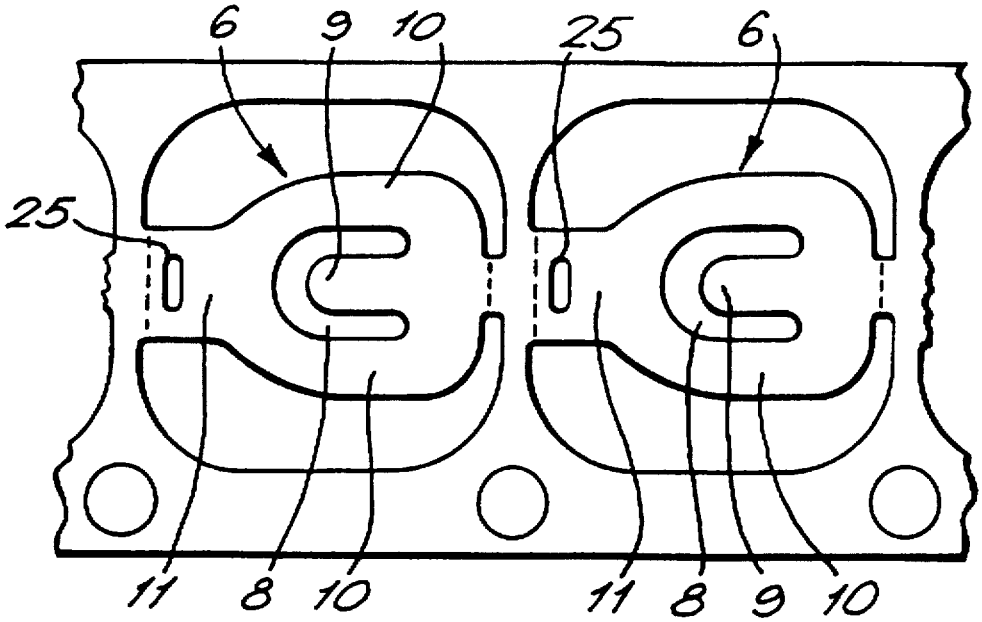
FIG. 6 is a plan view showing the form of leaf spring used in the second embodiment, the spring being shown in the form in which it is produced from continuous spring metal strip by a continuous stamping operation and before its final tooling for incorporation into the switch.

The views in FIGS. 1 to 4 of the accompanying drawings of the first embodiment show the switch to an enlarged scale and the dimensions indicated are the actual dimensions of the switch in millimetres. The moulded plastics body portion 1 of the switch is thus generally rectangular with dimensions of 12.35 mm×8.0 mm×3.4 mm and the first and second terminal conductors 2,3 project outwardly by a further 4.5 mm. A top cover for the switch is not shown in the drawings but has a thickness of 0.5 mm. The switch thus has such small overall size that it may conveniently be supplied in a bandolier suitable for use by automatic component insertion equipment. Of course, these dimensions are exemplary only and differently sized switches could be constructed, particularly for use in different applications.

Within the body portion 1 of the switch there is defined a chamber 4 which has dimensions of the order of 9.0 mm×7.0 mm×2.4 mm, and an upstand 5 occupies part of this chamber. The first terminal conductor 2, formed as a cruciform metal stamping as can best be seen in FIG. 1A, is moulded into the body portion 1 at one end thereof with its forward end 2', that is to say its end which extends furthest into the switch body portion 1, locating in a recess in the upper surface of the upstand 5, and its cross part 2" exposed within the chamber. The second terminal conductor 3 is moulded into the opposite end of the switch body portion 1 at a lower level than the first conductor 2 and comprises a generally T-shaped metal stamping the head 3' of which is exposed at the bottom of the chamber 4 defined within the body portion 1 of the switch.

FIG. 2 shows the shape of the leaf spring 6 that is incorporated into the switch of FIGS. 1 to 4 and correspondingly shows the shape of the bimetallic actuator 7 of the switch, these two components advantageously, in this embodiment, being of the same shape and being formed with one and the same tooling in automatic manufacture of the switch. As shown, the leaf spring and bimetallic actuator each comprises a dished blade of appropriate spring or bimetallic material having a generally U-shaped cut-out 8 which defines a tongue 9 between legs 10 which are bridged by a bridging portion 11. The moving contact of the switch is constituted by a silver contact 12 welded to the underside of the bridging portion of leaf spring 6 as can best be seen in FIG. 4. The bimetallic actuator 7 locates on top of and in registry with the leaf spring 6 and advantageously the two are secured together at their tongues by means of a weak weld, as a sub-assembly, before being secured to the forward portion 2' of the terminal conductor 2 by virtue of their tongues 9 being welded together thereto, formations 13 on the upper surface of the upstand 5 aiding the location of the tongues 9 relative to the body of the switch. The shape of the bimetallic blade 7 is such as to enhance its responsiveness to through currents by increasing the current density in the legs 10 and in the forward region of the blade where its bridging portion maintains physical and electrical contact with the underlying leaf spring 6.

As with the switch described in WO 92/20086 aforementioned, the upstand 5 provides furthermore for the support of the forward portion 2' of conductor 2 which in turn provides support for tongue portion 9 of leaf spring 6 and bimetallic actuator 7, whereas the legs 10 and bridging portions 11 of these parts are free to move within the chamber 4. By virtue of this arrangement, the temperature responsive characteristics of the switch can better be predetermined since switching operations are effected substantially exclusively by flexure of the legs 10 about the stable position established for the tongues 9 by virtue of their support on conductor 2. Furthermore, by supporting the tongues 9 in this way, the risk of stress cracking at the root of the tongue is reduced and the working stresses in the bimetal and in the leaf spring are concentrated towards their legs 10.

The fixed contact 14 of the switch is constituted in the embodiment in question by a silver contact welded to the head 3' of the T-shaped second conductor 3 where it is exposed within the internal chamber 4 of the switch. It could alternatively be formed by inlaying a silver portion into the conductor head 3', or by forming the conductor head 3' in accordance with the teachings of WO 92/14282, namely by forming the conductor 3 of copper or of a copper alloy having a thermal conductivity at least 90% that of copper, and more preferably 95% to 99% that of 99.95% pure copper, and providing at least the conductor head 3' with a thick plating layer of silver and antimony. By use of a thick plating (eg. 20 to 30 microns and preferably 40 microns thickness) comprising fine silver (99.9% purity) with a small amount of antimony, typically about 1% and particularly between 0.3% and 0.7%, on a conductor formed of copper or a high thermal conductivity copper alloy, the formation of silver powder during switching operations is inhibited and a switching contact life of the order of at least 70,000 switching cycles may be obtained.

In operation of the switch as thus described, the cold condition of the switch is such that the bimetal 7 overcomes the spring bias of the leaf spring 6 thereby holding the contact carried by the leaf spring in contact with the contact carried by the portion 3' of conductor terminal 3. In this condition the leaf spring 6 shunts the bimetal 7 so that a proportion of the through current of the switch by-passes the bimetal. Whenever the temperature of the bimetal rises to a certain predetermined level, as a result of thermal conduction from the switch environment and/or as a result of heating of the bimetal by current flow therethrough and/or through the adjoining leaf spring, the bimetal will move to its oppositely dished configuration with a snap action thereby releasing the leaf spring and allowing it to move under its own spring bias into a contacts open position. When the bimetal subsequently cools sufficiently the switch will remake, the force developed by the bimetal overcoming the spring force of the leaf spring.

The use of the leaf spring 6 to shunt the bimetallic actuator 7 increases the current capacity of the switch and increases the first break time of the switch, that is to say the time that the switch takes to go open circuit for the first time after initiation of an excessive through-current. An extended first break time is advantageous for the avoidance of nuisance tripping in use of the switch in applications, such as motor protection applications for example, where the switch will initially be subjected to a relatively high, but not abnormal, through current on start-up of the motor and the current will decrease as the motor picks up speed. The operation of the leaf spring in opposition to the bimetal in this embodiment ensures that when operated the spring remains in close physical and thermal contact with the bimetal. This results in long off times for the switch, which enhances the protective function of the switch.

In addition to the advantages abovementioned, the use of the leaf spring to shunt the bimetal has the further advantage that a range of switch application specifications can be accommodated by use of but a single bimetal material, the variations between different specifications being accommodated by selection of the physical and/or electrical characteristics of the spring material. Further variation can be achieved by selection of the bimetallic material also, and even further variation is obtainable by selection of the material of the terminal conductors 2 and/or 3, it being noted that the portions 2' and 2" of the conductor 2 are ideally located for use as a heat source to pump heat into the bimetal if the conductor 3 is suitably formed for example of a resistive material and/or with thinned portions so that it develops heat in use of the switch.

Again, as with the switch described in WO 92/20086, the closure may conveniently be moulded as an integral part of the switch body which is hingedly coupled thereto and may be ultrasonically welded shut after assembly of the leaf spring and the bimetal into the switch chamber and spot welding of the tongues of the same to the forward part 2' of conductor 2. The closure may be formed so as to isolate the chamber 4 from the environment of the switch, or may alternatively be provided with one or more openings.

The described switch is well suited to automatic manufacture and installation, comprises a minimum of parts and can be relatively inexpensive, and is capable of miniaturisation for enhanced current sensitivity. The switch as described is, however, but an example of what is achievable within the ambit of the present invention and modifications and variations are possible without departure from the spirit and scope of the invention. For example, whilst it is advantageous to form the leaf spring and the bimetal in the same shape, this is not essential to the invention, and whilst it is advantageous that the bimetal has no attachment to the leaf spring except where the two are welded together to the connector part 2', this also is not essential and the spring could have portions at its free (contact carrying) end which engage loosely with the bimetal to ensure that any tendency of the spring-carried contact to stick to the fixed contact is resisted not only by the spring force of the leaf spring itself but also is resisted by the force generated by the bimetal as it switches from its cold to its hot condition. The illustrated arrangement of the terminal conductors 2,3 is also subject to modification, and plain wire conductors as disclosed in WO 92/20086 could alternatively be utilized as could alternative surface mounting type terminals or alternative terminal shapes, lengths and/or arrangements. The switch could also be modified to incorporate series and/or parallel heating components as discussed in WO 92/20086.

Referring now to FIGS. 5 to 8 of the accompanying drawings, these illustrate a second embodiment of the present invention which incorporates some of the above-mentioned possibilities for modification and variation of the first embodiment. As with the drawings showing the first embodiment, the drawings showing the second embodiment are to an enlarged scale, 10 times actual size in the case of FIGS. 5A to 5F and FIG. 5I and 20 times actual in the case of FIGS. 5G and 5H, and the dimensions shown are in millimetres. Furthermore, the same reference numerals are employed to designate parts of the second embodiment as were used to designate like parts in the foregoing description of the first embodiment.

For the sake of conciseness, only the principal differences between the first and second embodiments will be described hereinafter and other detail changes will not be described, but will nonetheless be clear to the appropriately skilled reader. Principally, it will be seen that the metal terminal parts of the second embodiment are designed to enable the switch to be used selectively with either in-line or end-to-end terminations, that the leaf spring and the bimetallic actuator are loosely coupled together at their otherwise free ends, which enables a leaf spring to be used which develops a spring force tending for example to close the switch contacts rather than a contacts opening force as in the first embodiment, and that the moulded plastics body portion of the switch has an opening enabling a thinned section of a metal terminal part in the switch to act as a heater without being totally enclosed in plastics material.

Figure 8A:
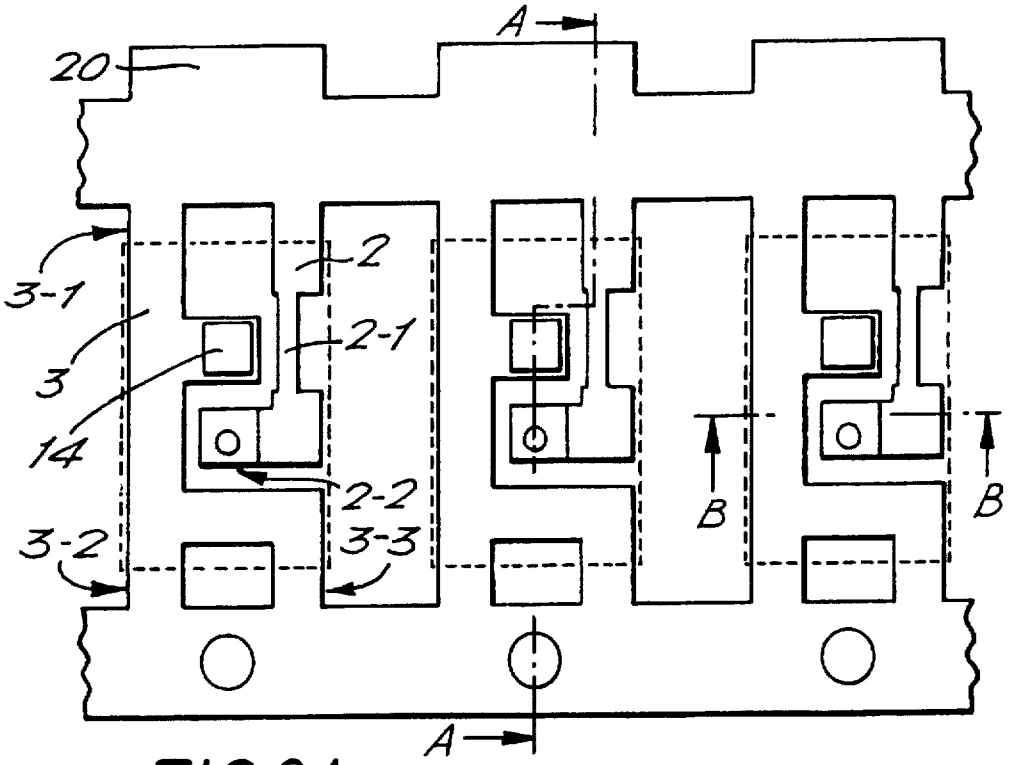
FIGS. 8A to 8D are views showing the formation of the metal terminal parts of the second embodiment, FIG. 8A being a top plan view showing how the metal parts for a plurality of switches are produced from continuous metal strip by a continuous stamping operation, FIGS. 8B and 8C being sectional views and FIG. 8D being a perspective view showing the form of the metal parts as incorporated into a single moulded plastics switch body and cropped from the continuous strip.
Figure 8C:
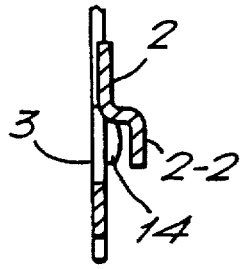
Figure 8D:
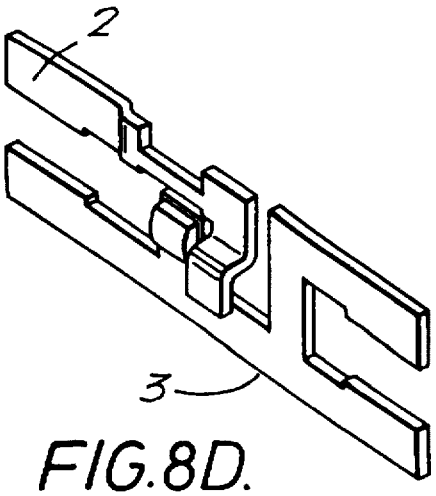
Figure 8B:
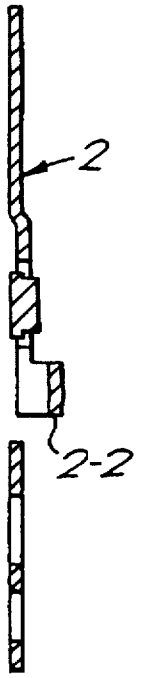
Figure 9A:
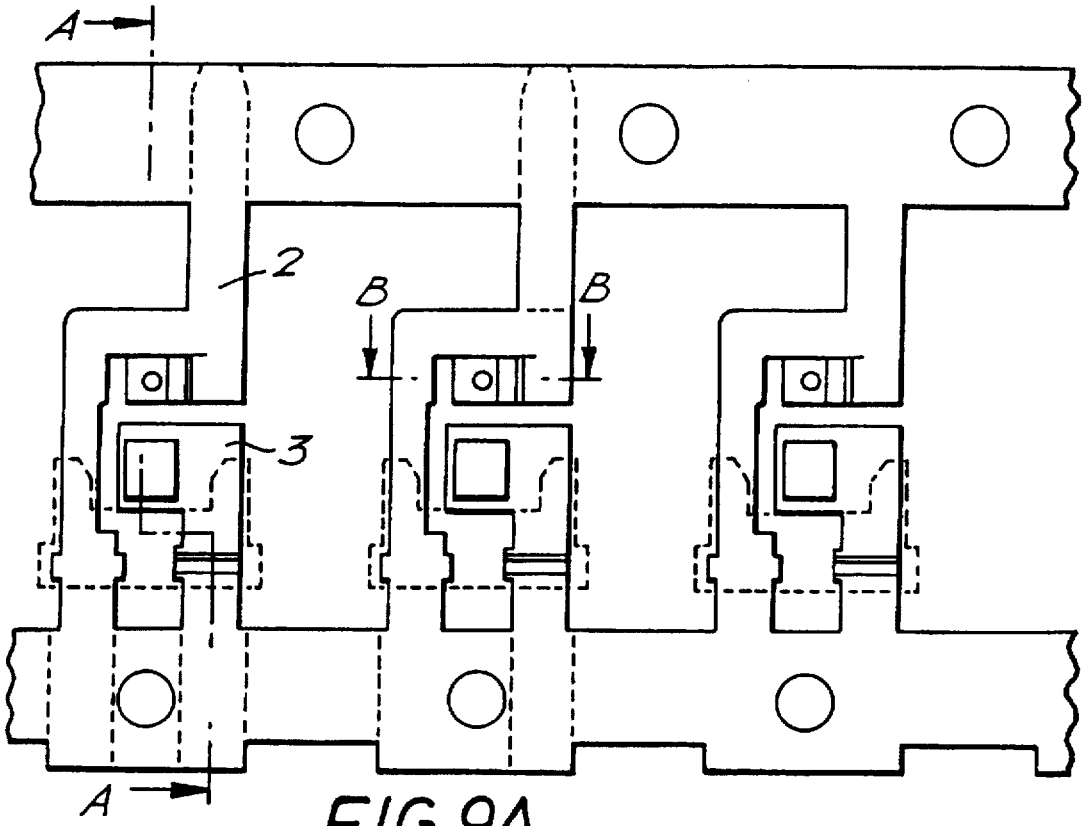
FIGS. 9A to 9D are views similar to those of FIGS. 8A to 8D and showing an alternative form of metal parts.
Figure 9D:
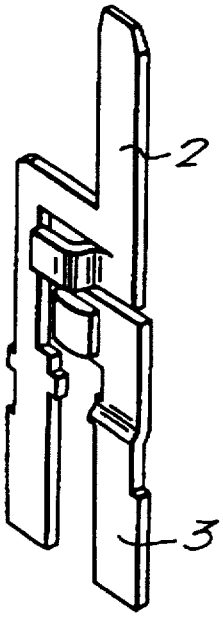
Figure 9C:
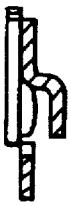
Figure 9B:
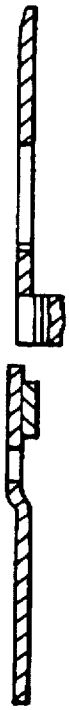
Figure 10A:
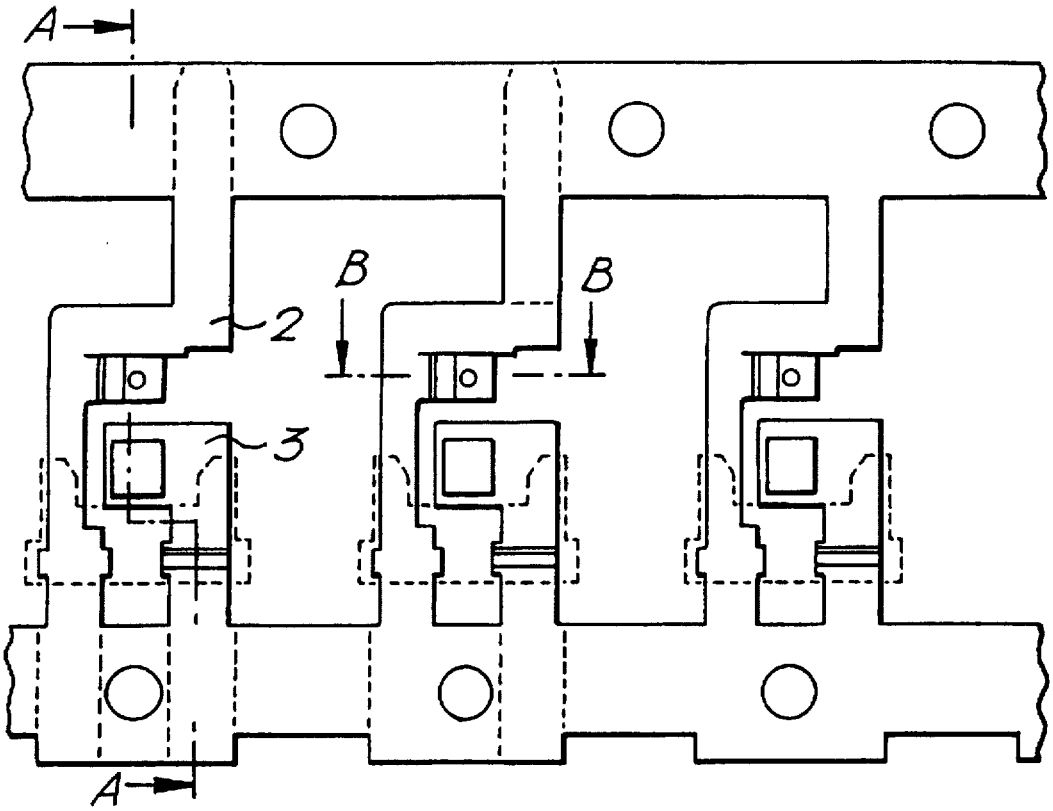
FIGS. 10A to 10C are views similar to those of FIGS. 9A to 9C and showing a modified form of the alternative metal parts.
Figure 10B:
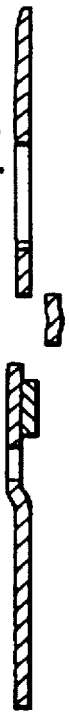
Figure 10C:
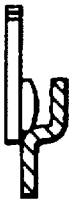

Referring more particularly to the drawings, FIGS. 8A to 8C show how the terminal parts 2 and 3 of the switch are formed by stamping from a continuous metal strip 20 so as to form a series of terminal part sets which remain attached to opposed longitudinal edges of the strip 20 during subsequent automated manufacturing processes involving the attachment of the silver fixed contact 14 to a respective portion of the terminal 3, the moulding of the switch body 1, and the attachment of the leaf spring 6 and bimetallic actuator 7 to a respective portion of the terminal 2. As shown most clearly in FIG. 8A, the first terminal 2 has a laterally-inverted L-shape and is formed with a thinned portion 2-1 which serves as an electrical resistance heater and an upstanding portion 2-2, see particularly FIG. 8B, which serves as a mounting for the leaf spring 6 and the bimetallic actuator 7. The second terminal 3 is generally h-shaped and has an upper limb 3-1 which, as shown in FIG. 5A, is adapted to project from the same end of the switch body 1 as does the first terminal 2, and two spaced-apart lower limbs 3-2 and 3-3 which are adapted to project from the opposite end of the switch body. As will be appreciated by those possessed of the appropriate expertise, this terminal arrangement enables the switch to be used with either in-line or end-to-end terminations, the unwanted or redundant ones of second terminal limbs 3-1, 3-2 and 3-3 being cropped off. As can be seen from FIG. 5D, the terminal limbs 3-1, 3-2 and 3-3 are formed so as to have portions which are exposed on the underside of the plastics body moulding 1 so that an anvil cropping tool can be placed under the switch and the unwanted terminal limbs cropped off flush with the side(s) of the switch body.

Figure 7:
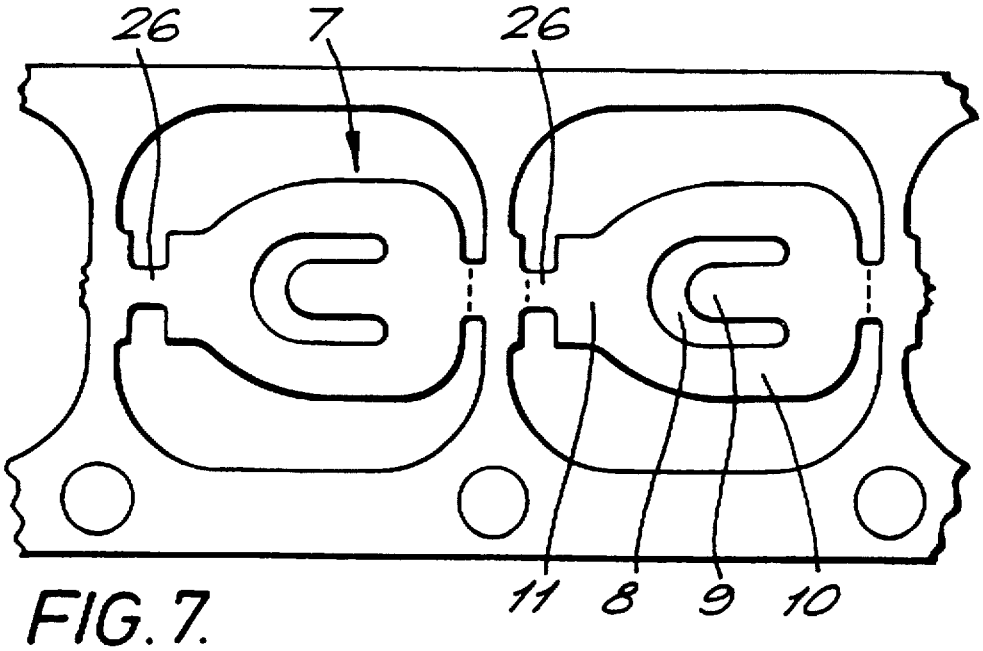
FIG. 7 is a plan view similar to that of FIG. 6 but showing the form of bimetallic actuator that is used in the second embodiment.

FIGS. 6 and 7 respectively show the form of the leaf spring 6 and of the bimetallic actuator 7, and it will be seen that in many respects these parts are identical to the corresponding parts of the first embodiment as shown in FIG. 2. However, FIGS. 6 and 7 illustrate the preferred manufacture of the leaf springs and bimetallic actuators from respective metal/bimetal strips in a continuous stamping process which provides elongate strips of series connected parts in a form which is well adapted for use in automatic switch manufacturing machinery.

FIG. 6 shows furthermore the formation of the spring blades 6 with an extended nose portion 11, as compared with the corresponding shape shown in FIG. 2, and a slot-like aperture 25 is formed in the elongated part of the nose portion 11 as shown. FIG. 7 shows the bimetal blade 7 formed with a tab 26 extending from its nose portion 11. In assembly of the switch, the nose portion 11 of the leaf spring 6 is bent upwardly through 90° so as to be upstanding from the general plane of the leaf spring and so that the aperture 25 is located in the upwardly bent part, and the tab 26 of the bimetallic blade 7 is loosely received in the aperture 25 in the leaf spring 6. With the tongue portions 9 of the leaf spring 6 and bimetallic blade 7 first lightly welded together as a sub-assembly which is subsequently welded to the upstanding portion 2-2 of the first terminal part 2, the engagement of the tab 26 of the bimetallic blade 7 in the aperture 25 of the leaf spring 25 couples the bimetal blade and leaf spring together in a loose fashion which requires them to move together but accommodates their individual movements so that neither is unduly loaded by the other. With this arrangement, the leaf spring does not have to be formed so as to develop a contacts-opening spring force opposing the bimetal action and can alternatively be made neutral or compliant to the bimetal action or so as even to develop contacts-closing forces so as, as described hereinbefore, to ensure that a positive contact pressure is obtained at temperatures below but closely approaching the switch opening temperature. In the latter case, the leaf spring may be tooled so as to be snap acting in its movement. Alternative means of coupling the leaf spring and bimetallic actuator together in an accommodating fashion are possible, but the described arrangement is simple and convenient and is particularly well suited to automated manufacturing procedures in that it necessitates only a minimum number of process steps.

Directing attention now to the thinned portion 2-1 of the first terminal part 2 which is intended to form a heater in the switch, it will be seen, particularly from FIG. 5D, that the switch body 1 has an opening 27 in its base at a location corresponding to the location in the switch of the heater part 2-1. This ensures that the heater operation is not unduly compromised by encasement of the heater in plastics material and ensures efficient heat transfer to the bimetallic actuator by conduction and radiation.

Referring now to FIGS. 9A to 9D and FIGS. 10A to 10C, these show alternative terminal arrangements providing optional in-line or end-to-end utilizations and furthermore providing selectable shorter or longer current paths through the switch. In the latter respect, it can be seen that the terminal portion 2-2 to which the leaf spring and bimetal blade are to be welded is released from the terminal 2 at one location in the arrangement of FIGS. 9A to 9D and at a different location providing different length current paths through the switch in the arrangement of FIGS. 10A to 10C, the length of the current paths depending furthermore upon whether an in-line terminal configuration or an end-to-end terminal configuration is employed. By virtue of these options, the resistance of the current path through the switch can be selected to be relatively low or relatively high and, in conjunction with selection of the material of the terminal elements 2 and 3 and/or of the leaf spring 6, the current sensitivity of the switch can be selected within a substantial range of possible sensitivities which means, basically, that the same switch configuration can readily be adapted for different current loads and different switching applications.

As with the first embodiment, the second embodiment is susceptible to modification and variation without departure from the spirit and scope of the invention as set forth in the appended claims. The invention enables the automatic manufacture of a series of basically similar switches spanning a wide switching range, for example from 4 amps to 36 amps. Further options would be possible by omission of the leaf spring and manufacturing switches otherwise identical to those hereinbefore described but with the bimetal itself carrying the moving contact of the switch.

I claim:

1. A thermally-responsive switch comprising a molded plastic body portion capturing therein first and second spaced-apart terminal conductors, a leaf spring cantilevered from one of said conductors and extending toward the other of said conductors, said leaf spring having a free end carrying a contact which constitutes a moving contact of the switch and is adapted to cooperate in switching operations with said other of the two conductors, and a snap-acting bimetallic actuator cantilevered from said one of said conductors and extending towards said other of said conductors, said bimetallic actuator cooperating with said leaf spring such that thermally induced movements of said bimetallic actuator transfer to the leaf spring to determine a condition of the switch, the bimetallic actuator being electrically shunted by the leaf spring which makes electrical contact with both a fixed end and said free end of the cantilevered bimetallic actuator.

2. The thermally-responsive switch as claimed in claim 1, wherein the leaf spring and the bimetallic actuator are similarly shaped.

3. The thermally-responsive switch as claimed in claim 1, wherein the bimetallic actuator comprises a dished bimetallic blade having a generally U-shaped cut-out defining a central tongue extending between a pair of external legs which are bridged by a bridging portion adjacent a tip of the tongue, and the tongue of the bimetallic blade is secured to said one of said terminal conductors.

4. The thermally-responsive switch as claimed in claim 3, wherein the tongue of the bimetallic blade and the corresponding part of the leaf spring are commonly secured to said one of said conductors.

5. The thermally-responsive switch as claimed in claim 3, wherein the moving contact of the switch is carried by a part of the leaf spring that corresponds to the bridging portion of the bimetallic actuator.

6. The thermally-responsive switch as claimed in claim 3, wherein the molded plastics body portion of the switch defines a chamber which accommodates the bimetallic actuator and the leaf spring, and an upstand is defined within said chamber and provides support of the tongue of the bimetallic blade and for the corresponding part of the leaf spring.

7. The thermally-responsive switch as claimed in claim 1, wherein the leaf spring is adapted to develop a spring force tending to open the switch contacts, and wherein the bimetallic actuator overlies the leaf spring and is adapted to develop, when in cold condition, a force which overcomes the spring force of the leaf spring.

8. The thermally-responsive switch as claimed in claim 7, wherein the free ends of the leaf spring and the bimetallic actuator are devoid of a mechanical coupling.

9. The thermally-responsive switch as claimed in claim 1, wherein the leaf spring is adapted to develop a neutral spring force tending neither to open nor to close the switch contacts, and a mechanical coupling is provided between the free ends of the leaf spring and the bimetallic actuator.

10. The thermally-responsive switch as claimed in claim 1, wherein the leaf spring is adapted to develop a neutral spring force tending to close the switch contacts, and a mechanical coupling is provided between the free ends of the leaf spring and the bimetallic actuator.

11. The thermally-responsive switch as claimed in claim 9, wherein the bimetallic actuator overlies the leaf spring.

12. The thermally-responsive switch as claimed in claim 9, wherein the mechanical coupling comprises an aperture in one of the leaf spring and the bimetallic actuator, and a member on the other of the leaf spring and the bimetallic actuator which loosely engages said aperture.

13. The thermally-responsive switch as claimed in claim 1, wherein the leaf spring is adapted to be snap-acting in its operation.

14. The thermally-responsive switch as claimed in claim 1, wherein the molded plastic body portion of the switch defines a chamber which accommodates the leaf spring and the bimetallic actuator, the first and second terminal conductors are molded into the body portion of the switch at spaced locations so as to have exposed portions spaced apart from each other within said chamber and externally of the body portion, the bimetallic actuator and the leaf spring are directly welded to the exposed portion of said one of said conductors within the chamber, and the contact carried by the leaf spring cooperates with a contact defined by or provided on the exposed portion of the other of the two conductors within the chamber.

15. The thermally-responsive switch as claimed in claim 14, wherein at least one of said first and second terminal conductors has plural exposed portions externally of the body portion of the switch.

16. The thermally-responsive switch as claimed in claim 1, wherein the molded plastic body portion of the switch isolates the active components of the switch from an external environment of said switch.

17. The thermally-responsive switch as claimed in claim 1, wherein at least one of said terminal conductors comprises a resistance heating portion adapted to pump heat into the bimetallic actuator.

18. The thermally-responsive switch as claimed in claim 1, wherein a resistance heating element is provided in parallel with the switch conductors.

* * * * *